US008870331B2

(12) United States Patent
Mo et al.

(10) Patent No.: US 8,870,331 B2
(45) Date of Patent: Oct. 28, 2014

(54) SYSTEM AND METHOD FOR PROCESS DIRECTION ALIGNMENT OF FIRST AND SECOND SIDE PRINTED IMAGES

(71) Applicant: Xerox Corporation, Norwalk, CT (US)

(72) Inventors: Song-Feng Mo, Webster, NY (US); Yongsoon Eun, Webster, NY (US); Timothy James Garwood, Pittsford, NY (US); Antariksh De, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 0 days.

(21) Appl. No.: 13/928,527

(22) Filed: Jun. 27, 2013

(65) Prior Publication Data

US 2014/0002531 A1 Jan. 2, 2014

Related U.S. Application Data

(60) Provisional application No. 61/666,371, filed on Jun. 29, 2012.

(51) Int. Cl.

| | |
|---|---|
| ***B41J 29/393*** | (2006.01) |
| ***B41J 13/00*** | (2006.01) |
| ***B41J 3/60*** | (2006.01) |
| ***B41J 11/46*** | (2006.01) |

(52) U.S. Cl.

CPC ..... *B41J 11/46* (2013.01); *B41J 13/0009* (2013.01); *B41J 3/60* (2013.01)

USPC ..... 347/16; 347/19

(58) Field of Classification Search

CPC ..... B41J 11/46; B41J 3/60

USPC ..... 347/16, 19

See application file for complete search history.

(56) References Cited

U.S. PATENT DOCUMENTS

| | | | |
|---|---|---|---|
| 7,686,298 | B2 | 3/2010 | Fioravanti et al. |
| 2005/0158106 | A1 | 7/2005 | Winter et al. |
| 2009/0016785 | A1 | 1/2009 | Haan et al. |
| 2011/0156345 | A1 | 6/2011 | deJong et al. |
| 2011/0257779 | A1 | 10/2011 | Theis et al. |

*Primary Examiner* — Julian Huffman

(74) *Attorney, Agent, or Firm* — Maginot, Moore & Beck LLP

(57) ABSTRACT

A method of duplex printing forms on a media web. The method includes identifying leading edges of a first side of the forms being printed in a first print zone and identifying leading edges of a second side of the forms being printed in a second print zone. The leading edges in the first print zone being identified with reference to a form length variation parameter and a drift parameter and the leading edges in the second print zone being identified with reference to another form length variation parameter and another drift parameter based on identification of leading edges in the first print zone.

18 Claims, 8 Drawing Sheets

SYSTEM AND METHOD FOR PROCESS DIRECTION ALIGNMENT OF FIRST AND SECOND SIDE PRINTED IMAGES

CLAIM OF PRIORITY

This application claims priority to U.S. Provisional Application No. 61/666,371, which is entitled "System And Method For Process Direction Alignment Of First And Second Side Printed Images," and was filed on Jun. 29, 2012.

TECHNICAL FIELD

This disclosure relates generally to inkjet printers, and, more particularly, to inkjet printers that print duplex images.

BACKGROUND

In a continuous web inkjet printer, some print jobs include duplex printing of forms. As used herein, the term "form" refers to a section of a larger print medium, such as a media web, that is identified by a pre-existing form indicator mark or feature. For example, top-of-form (TOF) indicators can include marks that are arranged at predetermined intervals along the length of the media web to delineate individual forms in the media web. The indicator marks are inscribed on the media web prior to the media web roll being mounted in the printer and passed through the printer. Other indicators include holes that extend through the media web at predetermined intervals. During a printing operation, the printer registers individual printed pages with the form indicators to produce printed images that are registered with the predetermined boundaries of the forms on the media web. In some embodiments, the media web includes pre-printed text or images in each form page, and the printing engine forms printed images that are superimposed on the pre-printed markings. In duplex printing, two print engines in one or more printers print images onto opposing sides of individual forms on the print medium. These images on opposing sides are registered with the form indicators on each side of the media and with each other in the process direction. After completion of the printing process, the web is separated along the boundaries between forms to produce individual duplex printed forms.

Existing printing systems perform duplex form printing by timing the operation of printheads or other marking units to form images on each side of the forms with reference to the pre-existing form indicator marks or features. In some duplex printers, however, the media web can experience deformation or slip in the media path within the printer. Either or both of the deformation and slip can introduce registration errors for printed forms that the existing methods for registration based on only on form indicator location fail to correct. Thus, improvements to methods for registration of printed images on the first side and second side of a form would be beneficial.

SUMMARY

In one embodiment, a method for operating a duplex printer has been developed. The method includes identifying a leading edge of a first side of each form in a plurality of forms on a media web moving past a first printhead configured to eject ink onto the first side of each form, the leading edge of each form being identified with reference to a form length variation parameter associated with the first printhead and a drift parameter associated with the first printhead, identifying a leading edge of a second side of each form in the plurality of forms moving past a second printhead configured to eject ink onto the second side of each form that is a reverse side of the first side of each form, the leading edge of each form on the reverse side being identified with reference to a form length variation parameter associated with the second printhead and a drift parameter associated with the second printhead, the form length variation parameter and the drift parameter associated with the second printhead being generated with reference to a plurality of leading edge identifications generated for the plurality of forms moving past the first printhead.

In another embodiment, a duplex printer has been developed. The printer includes a media transport configured to move a media web in a process direction past a first printhead that is configured to print on a first side of the media web and a second printhead that is configured to print on a second side of the media web, the second printhead being located from the first printhead in the process direction to enable the second printhead to print the second side of the media web after the first printhead has printed the first side of the media web. The printer further includes a first optical detector configured to generate a first signal in response to detection of a form indicator corresponding to one form in a plurality of forms on the first side of the media web passing the first optical detector, and a second optical detector configured to generate a second signal in response to detection of a registration mark printed by the first printhead in the form on the first side of the media web passing the second optical detector. The printer further includes a controller operatively connected to the first printhead, second printhead, first optical detector, second optical detector, and a memory. The controller is configured to identify a leading edge of a first side of each form in the plurality of forms on the media web, the leading edge of each form being identified with reference to a form length variation parameter associated with the first printhead and a drift parameter associated with the first printhead, and identify a leading edge of a second side of each form in the plurality of forms moving past a second printhead configured to eject ink onto the second side of each form that is a reverse side of the first side of each form, the leading edge of each form on the reverse side being identified with reference to a form length variation parameter associated with the second printhead and a drift parameter associated with the second printhead, the form length variation parameter and the drift parameter associated with the second printhead being generated with reference to a plurality of leading edge identifications generated for the plurality of forms moving past the first printhead.

BRIEF DESCRIPTION OF THE DRAWINGS

The foregoing aspects and other features of a printer that duplex prints forms are explained in the following description, taken in connection with the accompanying drawings.

DETAILED DESCRIPTION

Figure 1A:
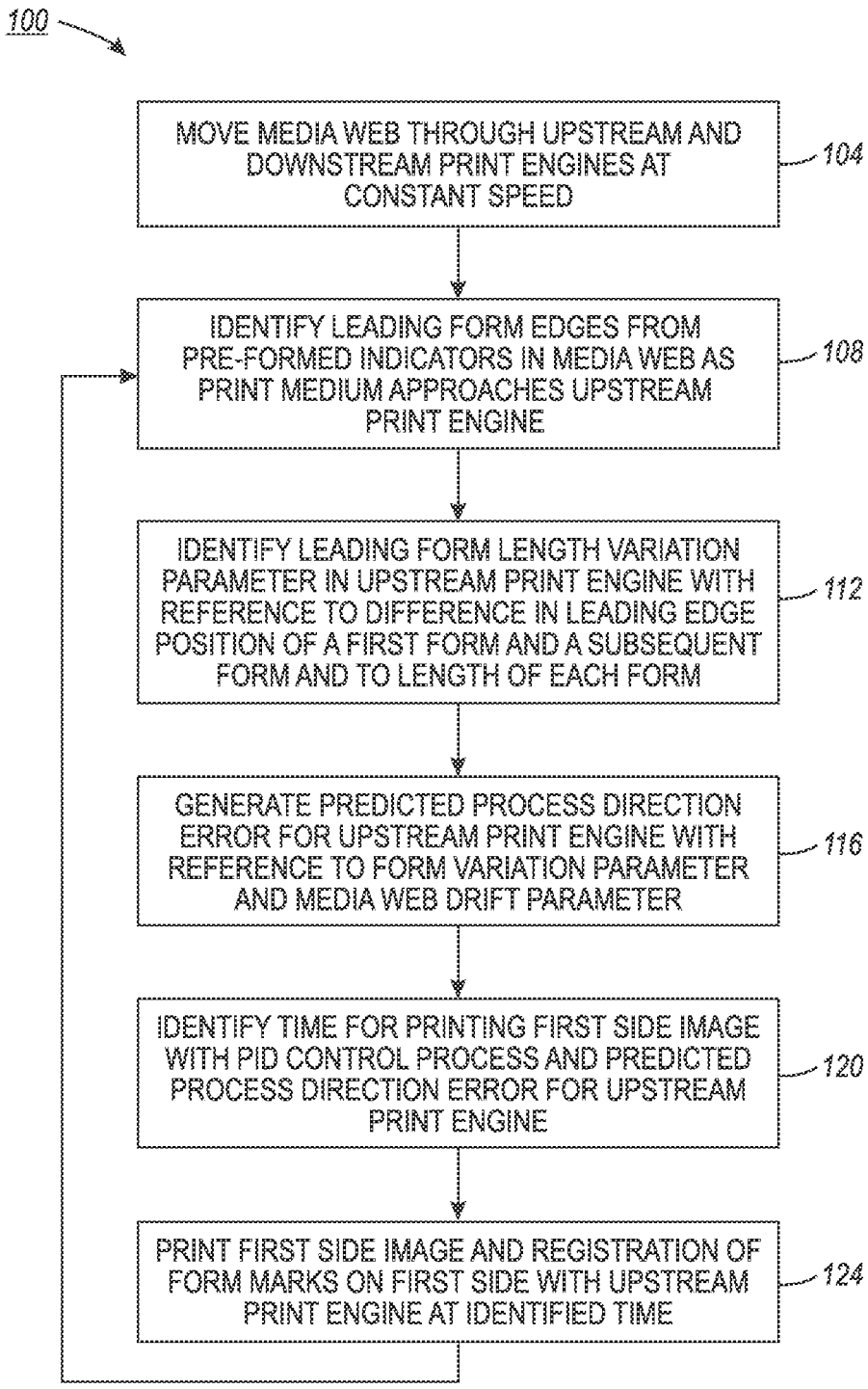
FIG. 1A is a block diagram of a process for printing first side images that are registered with a plurality of forms on a first side of a media web that is moving with a substantially constant velocity.

For a general understanding of the environment for the system and method disclosed herein as well as the details for the system and method, reference is made to the drawings. In the drawings, like reference numerals have been used throughout to designate like elements. As used herein, the word "printer" encompasses any apparatus that produces images with colorants on media, such as digital copiers, bookmaking machines, facsimile machines, multi-function machines, and the like. As used herein, the term "process direction" refers to a direction of movement of a print medium, such as a continuous media web pulled from a roll of paper or other suitable print medium along a media path through a printer. The print medium moves past one or more printheads in the print zone to receive ink images and passes other printer components, such as heaters, fusers, pressure rollers, and on-sheet imaging sensors, that are arranged along the media path. As used herein, the term "cross-process" direction refers to an axis that is perpendicular to the process direction along the surface of the print medium.

As used herein, the term "print engine" refers to a control system for a printer that is configured to move a print medium through a print zone and time the operation of the inkjets in one or more printheads with reference to electronic image data to print an image on one side of a print medium with a marking agent such as an ink or toner. In a duplex printing process, two different print engines each form one side of a duplex printed image on a print medium. As described in more detail below, a single printer can include two print engines that print opposing sides of a form in a duplex printing mode, or two different printers, each of which includes a print engine that prints on one side of the print medium.

As used herein, the terms "upstream" and "downstream" refer to relative locations along a media path in a continuous web printing system that can include one or more print engines. The media web moves in a process direction past a first, upstream, print engine followed by a second, downstream, print engine. The media web moves along a media path through the print engines from the upstream location to the downstream location. The upstream print engine forms a series of printed images on one side of the media web as the media web passes the upstream print engine. The downstream print engine subsequently forms a series of printed images that are aligned with the first side printed images as the media web passes the downstream print engine.

As used herein, the term "form length variation parameter" refers to a numeric parameter that identifies distortions or other changes in the length of a form in a larger media web from an expected length of the form. For example, a form can have an expected length of 30 centimeters, but due to stretching or shrinkage the actual length of the form in the printer can be longer or shorter than the expected length. As described in more detail below, the form length variation parameter can be expressed as a ratio between the actual length of the form and the expected length of the form.

As used herein, the term "drift parameter" refers to a numeric parameter that identifies misregistration between the form and image. The misregistration can be produced by an unintended movement of the media web in the process direction. For example, the media web can slip while moving in the process direction, which results in a deviation of the motion of the media web from the standard motion of the media web through the print engines. In another situation, the media web can temporarily stick to a component on the media path or be slowed down in an unintended manner that also produces a deviation in the movement of the media web. Web drift can also be produced when there is a mismatch between an expected form length and an actual form length. The size of the drift error accumulates over time as additional forms pass through the printer. The drift parameter is used to compensate for web drift to maintain process direction registration during duplex printing.

Figure 5:
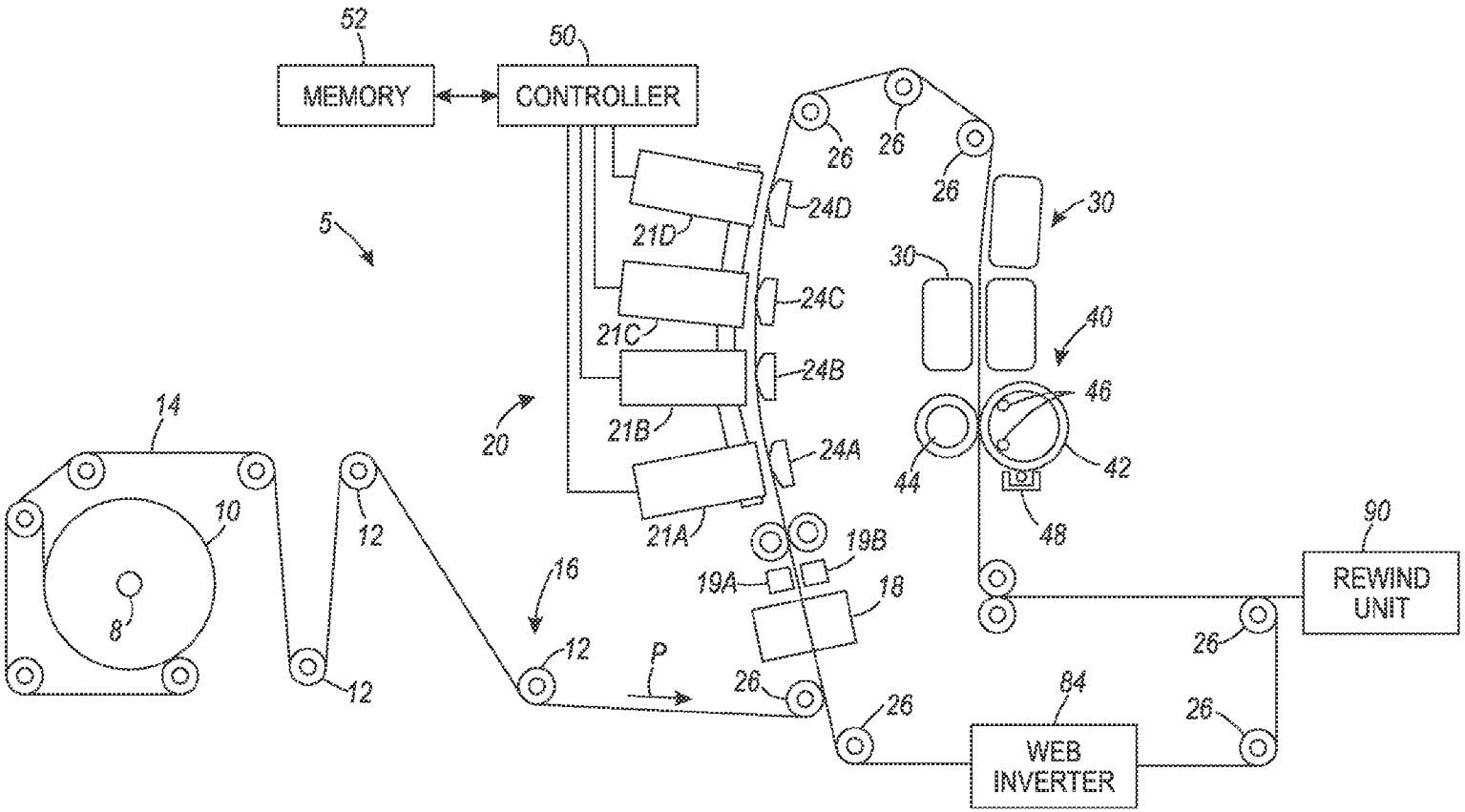
FIG. 5 PRIOR ART
FIG. 5 is a schematic diagram depicting a prior art inkjet printer that is configured to operate in a duplex print mode.

FIG. 5 depicts a prior-art inkjet printer 5. For the purposes of this disclosure, an inkjet printer employs one or more inkjet printheads to eject drops of ink onto a surface of an image receiving member, such as paper, another print medium, or an indirect member, such as a rotating image drum or belt. The printer 5 is configured to print ink images with a "phase-change ink," by which is meant an ink that is substantially solid at room temperature and that transitions to a liquid state when heated to a phase change ink melting temperature for ejecting onto the imaging receiving member surface. The phase change ink melting temperature is any temperature that is capable of melting solid phase change ink into liquid or molten form. In one embodiment, the phase change ink melting temperature is approximately 70° C. to 140° C. In alternative embodiments, the ink utilized in the printer comprises UV curable gel ink. Gel inks are also heated before being ejected by the inkjet ejectors of the printhead. As used herein, liquid ink refers to melted solid ink, heated gel ink, or other known forms of ink, such as aqueous inks, ink emulsions, ink suspensions, ink solutions, or the like.

The printer 5 includes a controller 50 to process the image data before generating the control signals for the inkjet ejectors to eject colorants. Colorants can be ink, or any suitable substance that includes one or more dyes or pigments and that is applied to the selected media. The colorant can be black, or any other desired color, and some printer configurations apply a plurality of distinct colorants to the media. The media includes any of a variety of substrates, including plain paper, coated paper, glossy paper, or transparencies, among others, and the media can be available in sheets, rolls, or other physical formats.

The printer 5 is an example of a direct-to-web, continuous-media, phase-change inkjet printer that includes a media supply and handling system configured to supply a long (i.e., substantially continuous) web of media 14 of "substrate" (paper, plastic, or other printable material) from a media source, such as spool of media 10 mounted on a web roller 8. The media web 14 includes a large number (e.g. thousands or tens of thousands) of individual pages that are separated into individual sheets with commercially available finishing devices after completion of the printing process. In the example of FIG. 5, the media web 14 is divided into a plurality of forms that are delineated with a series of form indicators that are arranged at predetermined intervals on the media web 14 in the process direction. Some webs include perforations that are formed between pages in the web to promote efficient separation of the printed pages.

For duplex operations, the web inverter 84 flips the media web 14 over to present a second side of the media to the print zone 20, before being taken up by the rewind unit 90. In duplex operation, the media source is approximately one-half of the roller widths as the web travels over one-half of the surface of each roller 26 in the print zone 20. The inverter 84 flips and laterally displaces the media web 14 and the media web 14 subsequently travels over the other half of the surface of each roller 26 opposite the print zone 20, for printing and fixing of the reverse side of the media web 14. During first-side printing in the print zone 20, a first plurality of printheads in each of the printhead units 21A-21D form a first side image on the media web 14 during a first upstream pass through the print zone 20 and the spreader 40. The web inverter 84 re-routes the second side of the media web 14 through a second plurality of printheads in each of the printhead units 21A-21D during a second downstream pass through the print zone 20 and the spreader 40. Thus, the print zone 20 includes both an upstream print engine that operates the first plurality of printheads that form the first side printed images and a downstream print engine that operates the second plurality of printheads that form the second side printed images. The rewind unit 90 is configured to wind the web onto a roller for removal from the printer and subsequent processing.

Figure 6:
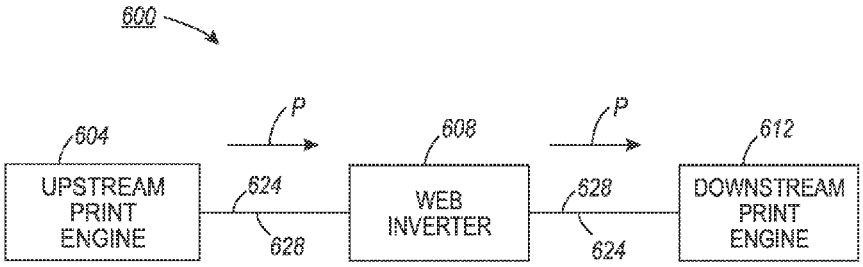
FIG. 6 PRIOR ART
FIG. 6 schematic diagram of a prior art upstream print engine and a downstream print engine that form duplex printed images on a continuous print medium.

In another duplex printing configuration, two printers with the configuration of the printer 5 are arranged serially with a web inverter interposed between the two printers to perform duplex printing operations. As depicted in FIG. 6, a first upstream print engine 604 includes one or more printheads or another marking device that prints ink images on a first side 624 of a continuous media web. The media web passes through a web inverter 608 that flips the media web to present a second side 628 of the media web for printing in a second downstream print engine 612. The downstream print engine 612 includes another printhead or marking device. In the example of FIG. 6, the media web moves in the process direction P from the upstream print engine 604, to the downstream print engine 612 through the web inverter 608. In the serial duplex printing configuration, the width of the media web can substantially cover the width of the rollers in both printers over which the media travels during duplex printing.

Referring again to FIG. 5, the media web 14 is unwound from the source 10 as needed and a variety of motors, not shown, rotate one or more rollers 12 and 26 to propel the media web 14. The media conditioner includes rollers 12 and a pre-heater 18. The rollers 12 and 26 control the tension of the unwinding media as the media moves along a path through the printer. In alternative embodiments, the printer transports a cut sheet media through the print zone in which case the media supply and handling system includes any suitable device or structure to enable the transport of cut media sheets along a desired path through the printer. The pre-heater 18 brings the web to an initial predetermined temperature that is selected for desired image characteristics corresponding to the type of media being printed as well as the type, colors, and number of inks being used. The pre-heater 18 can use contact, radiant, conductive, or convective heat to bring the media to a target preheat temperature, which in one practical embodiment, is in a range of about 30° C. to about 70° C.

As the media web 14 approaches a print zone 20, the media web passes two reflective optical sensors 19A and 19B. The sensor 19A generates a signal when an printed form indicator mark on the first side of the media web 14 or a hole that extends through the media web 14 passes the sensor 19A. As described below, the signals from the sensor 19A are used to identify the boundaries between forms and to identify deformation and slip in the media web 14 during first side printing in the upstream print engine. The sensor 19B generates a signal when a registration of form (ROF) mark that is printed on the first side of the print medium by the upstream print engine during the first side print process passes the sensor 19B as the media web 14 approaches the downstream print engine. As described below, the signals from the sensor 19B are used to identify deformation and slip in the media web 14 and to register second side images with the previously printed first side images during second side printing in the downstream print engine.

The media web 14 continues in the process direction P through the print zone 20 past a series of printhead units 21A, 21B, 21C, and 21D. Each of the printhead units 21A-21D effectively extends across the width of the media and includes one or more printheads that eject ink directly (i.e., without use of an intermediate or offset member) onto the media web 14. In printer 5, each of the printheads ejects a single color of ink, one for each of the colors typically used in color printing, namely, cyan, magenta, yellow, and black (CMYK).

The controller 50 of the printer 5 receives velocity data from encoders mounted proximately to rollers positioned on either side of the portion of the path opposite the four printheads to calculate the linear velocity and position of the web as the web moves past the printheads. The timing signals generated by the encoder wheels are referred to as a "dot clock" that includes a series of pulses corresponding to the movement of the media web. The speed of the media web is identified with reference to a count of the number of dot clock pulses that are generated within a predetermined time period, such as a number of pulses per second. The printer 5 includes one or more encoders that generate dot clocks in different regions of the media path. In another embodiment, a dot clock timing signal is generated by a sensor that detects a series of holes or other features that are formed in the media web 14. For example, in the printer 5 the optical sensor 19A can generate a signal when a small hole formed in the media web 14 moves past in the process direction P. The holes are located at regular intervals on the media web 14, and the signal from the optical sensor 19A can identify the speed of the web 14 and a length of the media web 14 that enters the print zone 20 in a given time period.

The controller 50 uses the media web velocity data to generate firing signals for actuating the inkjet ejectors in the printheads to enable the printheads to eject four colors of ink with appropriate timing and accuracy for registration of the differently colored patterns to form color images on the media. The inkjet ejectors actuated by the firing signals correspond to digital data processed by the controller 50. The digital data for the images to be printed can be transmitted to the printer, generated by a scanner (not shown) that is a component of the printer, or otherwise generated and delivered to the printer. In various configurations, a printhead unit for each primary color includes one or more printheads; multiple printheads in a single printhead unit are formed into a single row or multiple row array; printheads of a multiple row array are staggered; a printhead prints more than one color; or the printheads or portions thereof are mounted movably in a direction transverse to the process direction P for printing operations, such as for spot-color applications and the like.

Associated with each printhead unit is a backing member 24A-24D, typically in the form of a bar or roll, which is arranged substantially opposite the printhead on the back side of the media. Each backing member positions the media at a predetermined distance from the printhead opposite the backing member. The backing members 24A-24D are optionally configured to emit thermal energy to heat the media to a predetermined temperature, which is in a range of about 40° C. to about 60° C. in printer 5. The various backer members can be controlled individually or collectively. The pre-heater 18, the printheads, backing members 24A-24D (if heated), as well as the surrounding air combine to maintain the media along the portion of the path opposite the print zone 20 in a predetermined temperature range of about 40° C. to 70° C.

As the partially-imaged media web 14 moves to receive inks of various colors from the printheads of the print zone 20, the printer 5 maintains the temperature of the media web 14 within a given range. The printheads in the printhead units 21A-21D eject ink at a temperature typically significantly higher than the temperature of the media web 14. Consequently, the ink heats the media, and temperature control devices can maintain the media web temperature within a predetermined range. For example, the air temperature and air flow rate behind and in front of the media web 14 impacts the media temperature. Accordingly, air blowers or fans can be utilized to facilitate control of the media temperature. Thus, the printer 5 maintains the temperature of the media web 14 within an appropriate range for the jetting of all inks from the printheads of the print zone 20. Temperature sensors (not shown) can be positioned along this portion of the media path to enable regulation of the media temperature.

Following the print zone 20 along the media path are one or more "mid-heaters" 30. A mid-heater 30 can use contact, radiant, conductive, and/or convective heat to control a temperature of the media. The mid-heater 30 brings the ink placed on the media to a temperature suitable for desired properties when the ink on the media is sent through the spreader 40. In one embodiment, a useful range for a target temperature for the mid-heater is about 35° C. to about 80° C. The mid-heater 30 has the effect of equalizing the ink and substrate temperatures to within about 15° C. of each other. Lower ink temperature gives less line spread while higher ink temperature causes show-through (visibility of the image from the other side of the print). The mid-heater 30 adjusts substrate and ink temperatures to 0° C. to 20° C. above the temperature of the spreader.

Following the mid-heaters 30, a fixing assembly 40 applies heat and/or pressure to the media to fix the images to the media. The fixing assembly includes any suitable device or apparatus for fixing images to the media including heated or unheated pressure rollers, radiant heaters, heat lamps, and the like. In the embodiment of the FIG. 5, the fixing assembly includes a "spreader" 40, which applies a predetermined pressure, and in some implementations, heat, to the media. The function of the spreader 40 is to flatten the individual ink droplets, strings of ink droplets, or lines of ink on web 14 and flatten the ink with pressure and, in some systems, heat. The spreader flattens the ink drops to fill spaces between adjacent drops and form uniform images on the media web 14. In addition to spreading the ink, the spreader 40 improves fixation of the ink image to the media web 14 by increasing ink layer cohesion and/or increasing the ink-web adhesion. The spreader 40 includes rollers, such as image-side roller 42 and pressure roller 44, to apply heat and pressure to the media. Either roll can include heat elements, such as heating elements 46, to bring the web 14 to a temperature in a range from about 35° C. to about 80° C. In alternative embodiments, the fixing assembly spreads the ink using non-contact heating (without pressure) of the media after the print zone 20. Such a non-contact fixing assembly can use any suitable type of heater to heat the media to a desired temperature, such as a radiant heater, UV heating lamps, and the like.

In one practical embodiment, the roller temperature in spreader 40 is maintained at an optimum temperature that depends on the properties of the ink, such as 55° C. Generally, a lower roller temperature gives less line spread while a higher temperature produces imperfections in the gloss of the ink image. Roller temperatures that are too high may cause ink to offset to the roll. In one practical embodiment, the nip pressure is set in a range of about 500 to about 2000 psi lbs/side. Lower nip pressure produces less line spread while higher pressure may reduce pressure roller life.

The spreader 40 can include a cleaning/oiling station 48 associated with image-side roller 42. The station 48 cleans and/or applies a layer of some release agent or other material to the roller surface. The release agent material can be an amino silicone oil having viscosity of about 10-200 centipoises. A small amount of oil transfers from the station to the media web 14, with the printer 5 transferring approximately 1-10 mg per A4 sheet-sized portion of the media web 14. In one embodiment, the mid-heater 30 and spreader 40 are combined into a single unit with their respective functions occurring relative to the same portion of media simultaneously. In another embodiment, the media is maintained at a high temperature as the media exits the print zone 20 to enable spreading of the ink.

In printer 5, the controller 50 is operatively connected to various subsystems and components to regulate and control operation of the printer 5. The controller 50 is implemented with general or specialized programmable processors that execute programmed instructions. The instructions and data required to perform the programmed functions are stored in a memory 52 that is associated with the controller 50. The memory 52 stores programmed instructions for the controller 50. In the configuration of FIG. 5, the memory 52 also stores historic data corresponding to a plurality of forms in the media web 14 that have already been printed during both first and second side printing in a duplex print mode. The historic data include the times at which the upstream and downstream print engines in the print zone 20 begin printing the first side and second side, respectively, of each form. The historic data include a form length variation parameter that corresponds to measured stretch or shrinkage of previously printed forms in the media web. The historic data further include a web slip parameter that corresponds to measured amounts of slip in the media web 14 as the media web moves through the printer 5 in the process direction P. Ideally, the media web 14 moves at the same linear rate as the outer circumferences of the rollers 26 along the media path, but the media web may slip past the rollers 26 more quickly or stick temporarily and move more slowly than the linear rate of movement of the rollers 26. The slip parameters stored in the memory 52 identify the slip of the media web for a plurality of previously printed forms. The memory 52 also stores a value corresponding to the predetermined length of each form in the process direction. The predetermined length of the form refers to the length of each form in the process direction without including stretch or shrinkage due to web deformation that may occur in the printer 5.

In the controller 50, the processors, their memories, and interface circuitry configure the controllers and/or print engine to perform the printer operations. These components can be provided on a printed circuit card or provided as a circuit in an application specific integrated circuit (ASIC). Each of the circuits can be implemented with a separate processor or multiple circuits can be implemented on the same processor. Alternatively, the circuits can be implemented with discrete components or circuits provided in VLSI circuits. Also, the circuits described herein can be implemented with a combination of processors, ASICs, discrete components, or VLSI circuits. The controller 50 is operatively connected to the printheads in the printhead units 21A-21D. The controller 50 generates electrical firing signals to operate the individual inkjets in the printhead units 21A-21D to eject ink drops that form printed images on the media web 14. As described in more detail below, the controller 50 receives signals from the optical sensors 19A and 19B to identify pre-printed indicator marks and features as well as registration of form (ROF) marks that are printed on forms in the media web 14. The controller 50 identifies form deformations and slip in the media web 14, and implements proportional, integral, differential (PID) control processes to adjust the time of operation for the printhead modules 21A-21D to ensure process direction registration during duplex form printing.

Figure 4:
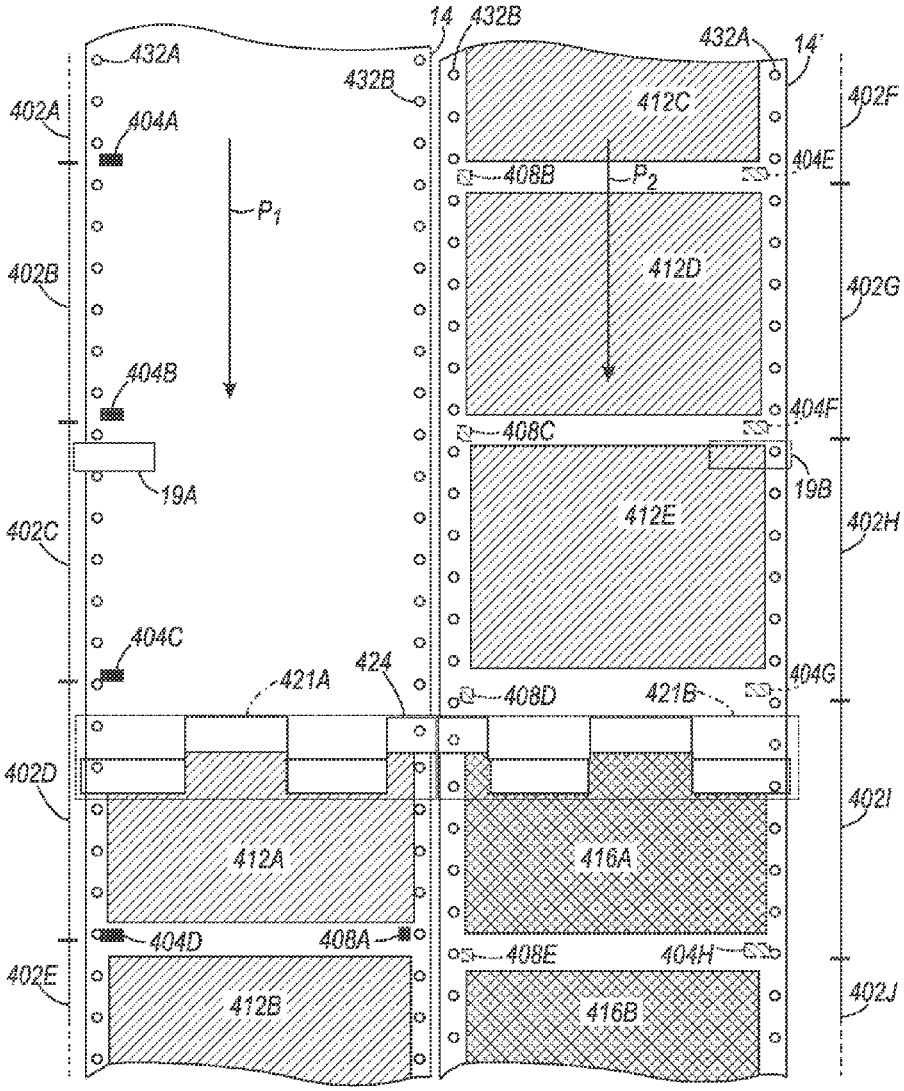
FIG. 4 is a plan view of a portion of a media path in a duplex printer with tandem upstream and downstream print zones.

FIG. 4 depicts a portion of a media path in the printer 5 in more detail. FIG. 4 depicts the media web 14 in a tandem arrangement, with a first portion of media web 14 passing a first set of printheads 421A in the printhead unit 21A for first-side printing in process direction P1. A second portion of the media web, which is labeled 14' in FIG. 4, passes a second set of printheads 421B in the printhead unit 21A for second-side printing in process direction P2. In the example of FIG. 4, one of the printheads 424 spans both the first side and second side of the media web 14 and includes groups of inkjets that form portions of both the first side and second side images in a tandem duplex printing configuration. The printheads 421A are part of the upstream print engine, and the printheads 421B are part of the downstream print engine. FIG. 4 only depicts selected printheads from the printhead unit 21A for simplicity, but printheads in each of the printhead units 21A-21D form first and second side images on the media web 14 during the duplex printing process.

As depicted in FIG. 4, top-of-form marks 404A-404H are formed on the first side of the media web 14 at predetermined intervals in the process direction. The top-of-form marks or other leading edge indicators are placed in the media web 14 prior to first-side printing. Thus, top-of-form marks 404A-404C are depicted on the blank media web 14 upstream from the first set of printheads 421A. In FIG. 4, the media web is depicted with separate forms 402A-402J. The leading edge indicators 404A-404H are located at the boundaries between individual forms on the media web. As the media web 14 approaches the first set of printheads 421A, the optical sensor 19A generates signals in response to a change in reflection when one of the top-of-form marks passes the optical sensor.

FIG. 4 also depicts two series of form holes 432A and 432B that are arranged on each side of the media web 14 in parallel with the process direction P1 and P2 for both simplex and duplex printing. The form holes are formed through the media web 14 at predetermined intervals in the process direction, such as at approximately 12.7 mm intervals. In the printer 5, the memory 52 stores a predetermined length of each form in the media web 14, and the optical sensors 19A and 19B can generate dot clock signals as the form holes 432A and 432B move past the optical sensors. The controller 50 can identify the leading edge of each form in the media web 14 with reference to the dot clock signals, the predetermined interval length between successive form holes, and the predetermined length of each form. FIG. 4 depicts both top-of-form marks 404A-404H and form holes 432A and 432B, but alternative media web configurations include only one of the top-of-form marks or the form holes.

The media web 14 moves through the print zone 20, and printheads in each of the printhead units 21A-21D form first side printed images 412A-412E. During the printing process, at least one printhead in the upstream print engine also forms a registration of form mark on each form in the media web 14. Registration of form marks 408A-408E are printed on the first side of the media web 14 in FIG. 4 by the printheads 421A. The media web 14 subsequently passes through the web inverter 84, and the media web 14' passes the second set of printheads 421B for printing of duplexed images 416A and 416B. The inverted media web 14 passes optical sensor 19B, which is located upstream of the second set of printheads 421B, and generates a signal in response to one of the registration of form marks 408A-408E moving past in the process direction P2. Unlike the top-of-form marks 404A-404H. The registration of form marks 408A-408E are printed with the printheads in the printer 5 during a printing process. Thus, distortions or slip that may occur in the media web 14 generate differences between the relative separation and registration of the top-of-form marks 404A-404H and the registration of form marks 408A-408E. As described below, a registration process enables control of the operation for the printheads in the printhead units 21A-21D to register printed images with the leading edge for each of the forms, and to register first side images with second side images during duplex printing.

Figure 1B:
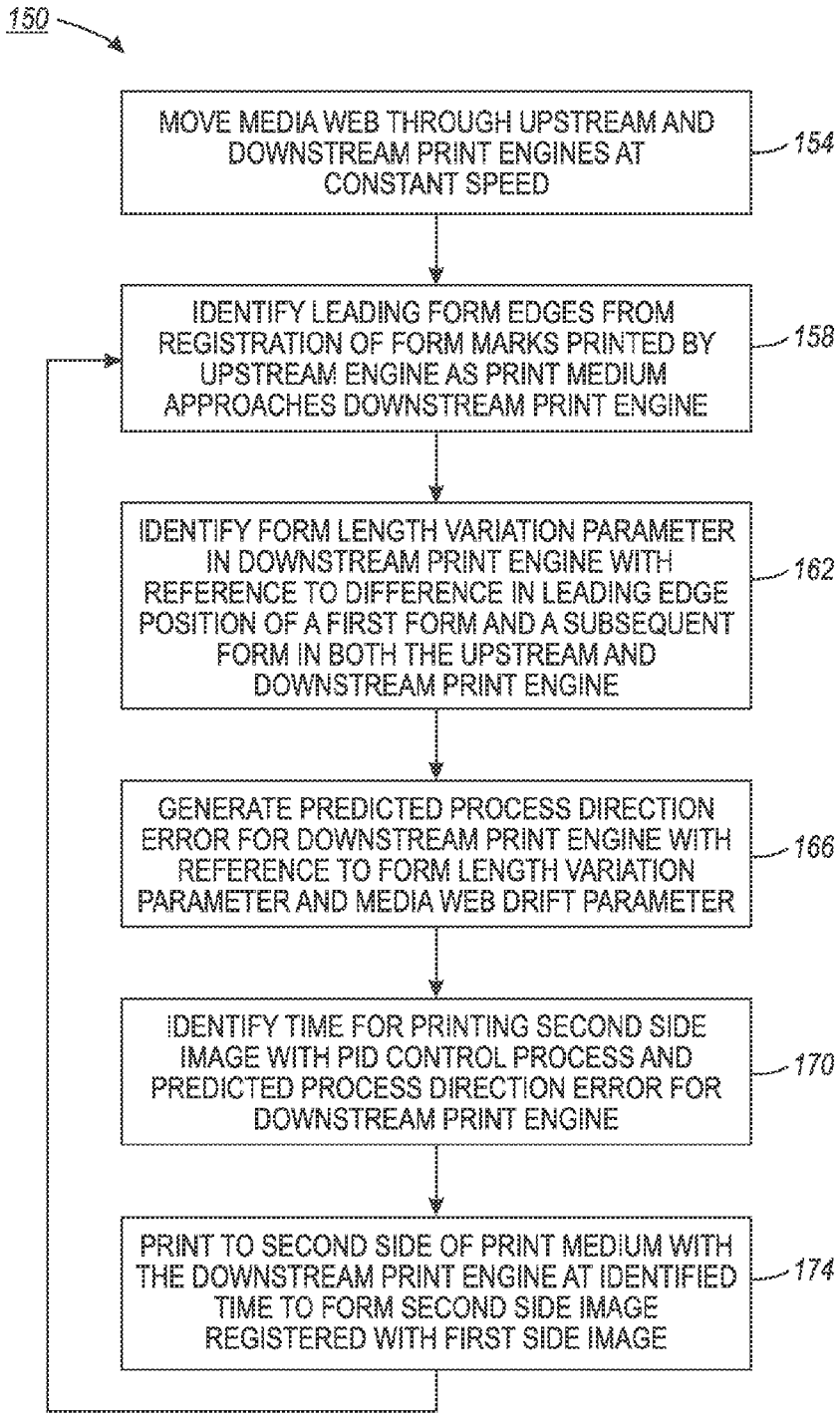
FIG. 1B is a block diagram of a process for printing second side images on a second side of the media web that are registered with the first side images while the media web moves at a substantially constant velocity.

FIG. 1A and FIG. 1B depict first side and second side printing processes 100 and 150, respectively. A duplex printer, such as the printer 5, or two simplex printers perform processes 100 and 150 concurrently to form duplex printed forms with printed images on first side forms being registered in the process direction with printed images on second side forms. In the discussion below, a reference to the processes performing a function or action refers to a controller executing programmed instructions stored in a memory to operate one or more components in a printer to perform the function or action. Processes 100 and 150 are described in conjunction with the printer 5 for illustrative purposes.

Figure 3:
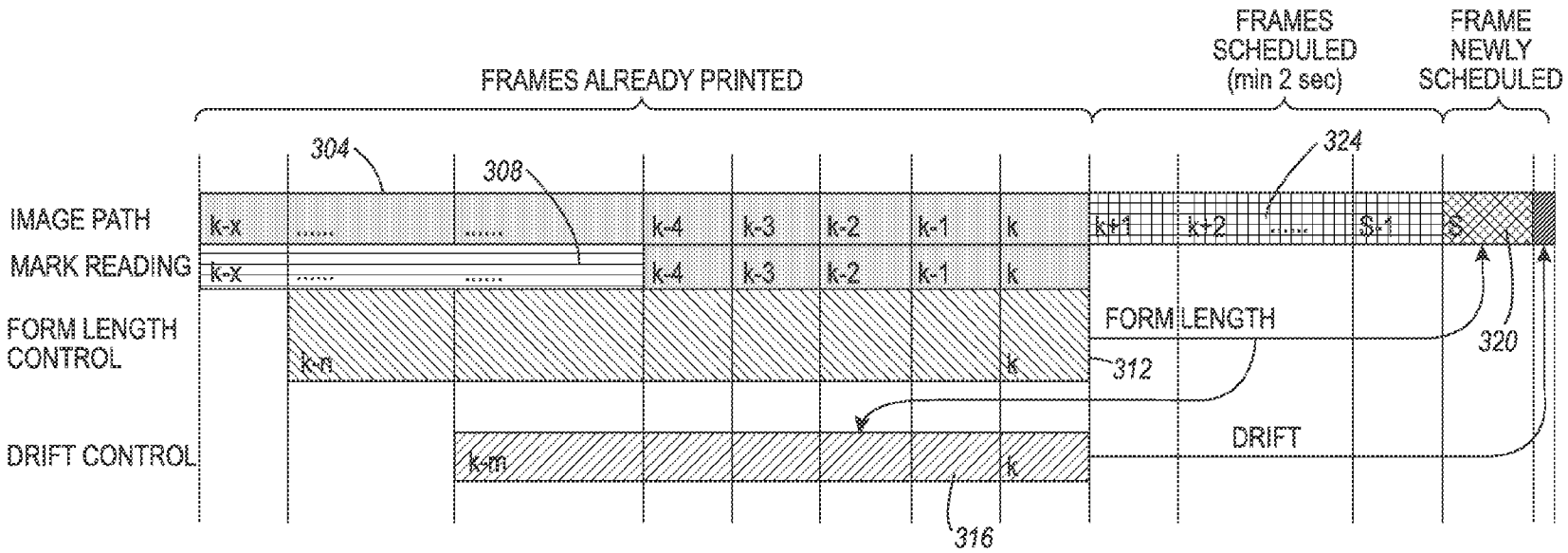
FIG. 3 is a diagram depicting a history of stored data corresponding to previously printed forms that are used to predict a process direction registration error for an upstream form prior to printing the upstream form in a duplex print mode.

Both of the processes 100 and 150 use data that correspond to the time, length, and position of previous forms in the media web 14 in order to predict a time at which to print a form that is approaching the print zone in either the upstream or downstream print engine. FIG. 3 depicts a timing diagram for use with processes 100 and 150. In FIG. 3, the image path includes a plurality of previously printed forms 304 having data that are stored in the memory 52. The data for the previously printed forms 306 include time values 308 corresponding to the time the optical detector identifies a registration mark for each form. The registration marks can include either pre-printed marks or holes formed on the media web prior to first-side printing, or registration of form marks formed during first side printing for second side form registration. The stored data include form length control values 312 that correspond to measured form length distortion that was identified for the previous forms in the media web. Additionally, the stored data include drift control values 316 that correspond to identified drift of the media web that was identified for the previous forms in the media web.

In the example of FIG. 3, the form length control data include more data points than the drift control data values 316. The data elements 304, 308, 312, and 316 form a past history of media web distortion and drift. During processes 100 and 150, the upstream and downstream print engines predict errors in the process direction registration for an upstream form 320 (form S) with reference to the previously identified data. The processes 100 and 150 predict process direction registration errors and generate adjusted printing times for the upstream form 320 in advance to enable the upstream and downstream print engines to compensate for process direction errors prior to the form 320 arriving in the print zone. In the example of FIG. 3, the processes 100 and 150 identify the time to print upstream form 320 approximately two seconds before the form arrives in the print zone. The upstream and downstream print engines print intermediate forms 324 prior to the arrival of the upstream form 320. The timing diagram of FIG. 3 represents a sliding window of forms. For example, the form S−1 in the intermediate forms 324 was the form S in a previous iteration of the processes 100 and 150. Thus, the upstream and downstream print engines generate an updating history of previously printed forms in order to predict errors in future forms and adjust the time of operation for the upstream and downstream print engines to compensate for the predicted errors.

Referring to FIG. 1A, process 100 begins by moving the media web through the media path in the upstream print engine and downstream print engine at a substantially constant speed (block 104). In the printer 5, the media web 14 moves through the print zone 20 a first time for first-side printing, and the web inverter 84 inverts the web 14 prior to the media web 14 passing through the print zone 20 a second time for second side printing. As described above, the printhead units 21A-21D in the print zone 20 are the upstream print engine during the first pass and the downstream print engine during the second pass of the media web 14. In the duplex printing system 600, the media web passes through the upstream print engine 604, web inverter 608, and downstream print engine 612.

As the media web 14 moves through the printer, individual forms in the media web 14 pass one or more reflective sensors, such as sensor 19A in the printer 5, as the forms approach the print zone 20. During process 100, the printer identifies pre-formed leading edge indicators for the individual forms in the media web 14 (block 108). The pre-formed indicators can include printed fiducial marks or small holes formed through the media web 14 to indicate the leading edge of individual forms in the media 14. In the printer 5, the controller 50 identifies a time at which the upstream sensor 19A generates a signal corresponding to the indicator passing the upstream sensor 19A. The controller 50 identifies a series of time values corresponding to the leading edge indicators in a series of forms in the media web 14. In one embodiment, the controller 50 stores a running window of n previous leading edge indicators, where n corresponds to a number of forms that occupy a predetermined length of the media web 14 in the process direction. In one embodiment, the controller 50 stores time values corresponding to leading edge indicators for forms arranged along a length of 1.5 meters of the media web 14.

As the media web 14 passes through the upstream print engine, the media web 14 may deform in the process direction. Typical types of deformation include stretching or shrinking of the media web 14 due to changes in tension, temperature, humidity, or other factors that affect the media web 14. Process 100 identifies a form length variation parameter corresponding to timing variations of the identification of leading edge indicators for different forms in the media web 14 (block 112). As described above, each of the plurality of forms in the media web 14 has a predetermined length in the process direction P. When the media web 14 moves through the print zone 20 at a substantially constant speed, the controller 50 identifies variations in the times at which leading edges of the forms are identified in proportion to the expected time at which leading edge indicators of the print medium pass the optical sensor 19A at a predetermined speed for a predetermined form length. In the example of FIG. 1A, the controller 50 identifies the form length parameter as a deformation gain $G_{DU}$ using the following equation:

$$G_{DU} = \frac{(LE_U(k) - LE_U(k-n))}{n \cdot FormLength}.$$

In the previous equation, the Formlength term represents the total dot clock count of either a form-length image printed on each form or the expected length of each form on the media web. In the previous equation, $LE_U$ represents the dot clock count values corresponding to the detection of the leading edge indicators for form identifier k and for an earlier form that was detected at dot clock count value for form identifier (k−n), where each of the n represents a length of time taken for a single form to pass the optical sensor 19A, and n is the total number of frames used. The dot clock count referred as a unit of distance in the context of process 100. When the forms in the media web 14 have the expected length in the process direction P, the gain value $G_{DU}$ is one. When the media web 14 stretches in the process direction P, the gain value $G_{DU}$ is greater than one, and when the web 14 shrinks in the process direction P, the gain value $G_{DU}$ is less than one.

Process 100 continues by identifying a predicted timing error for a form that is scheduled to be printed by the upstream print engine with reference to an identified media web drift and the identified web deformation gain value (block 116). Media web drift occurs when the media web 14 sticks or slips over the backer rollers 26 and other members in the media path instead of moving smoothly through the media path. Drift also occurs when the actual form length on the media web differs from the expected form length, which can lead to an accumulating registration error that grows to an unacceptable side before the printer detects and compensates for the form length variation. The drift does not affect the relative distance between the leading edge indicators for each form in the media web 14, but a portion of the media web 14 can shift upstream or downstream along the process direction P due to media drift. In the printer 5, the controller 50 identifies the predicted error time offset $Error_{SU}$ using the following equation: $Error_{SU}=(LE_U(k)-LE_U(k-m))-G_{DU}\cdot m\cdot FormLength$. The web drift is measured from a dot clock count value corresponding to the form identifier k measured for the detection of a leading edge indicator for a current form to a previous form at the earlier form identifier (k−m). The value of m represents a predetermined number of forms that the controller 50 monitors to identify drift in the media web 14. In one embodiment of process 100, the value of m is smaller than the value of n used to monitor web deformation during the processing of block 112 that is described above. The shorter time window for measuring web drift enables the controller 50 to identify drift in the media web over shorter time periods and to adjust the timing for operation of the printhead units 21A-21D to produce printed images that are aligned in the process direction P with the leading edge indicator in each form.

Process 100 does not use the predicted error value $Error_{SU}$ to adjust the timing of operation of the printhead units 21A-21D directly because random variations in the printing process can introduce inaccuracies into the error estimates that are produced for individual forms in the media web 14. Instead, process 100 generates a timing correction value using a proportional, integral, differential (PID) control process that incorporates the predicted error value (block 120). The PID controller generates an identified time schedule offset for the next printed form S with reference to the following equation:

$$LEinSchedulers_S = LEinSchedulur_{(S-1)U} + \left(\frac{(LE_U(k) - LE_U(k-n))}{n}\right) + K_p \cdot Error_{SU} + K_I \cdot A_{SU} + K_D \cdot D_{SU}.$$

In the previous equation, $LEinSchedulur_{(S-1)U}$ represents a previously identified time scheduler value that is identified during the previous iteration of the process 100 and corresponds to the time of operation for the printhead units 21A-21D when printing an image on a previous form. The term $$\left(\frac{(LE_U(k) - LE_U(k-n))}{n}\right)$$

represents an expected time offset for printing the next form S in the absence of media web distortion or media web drift. The terms $K_P$, $K_I$, and $K_D$ are empirically determined constants corresponding to the proportional, integral, and differential terms, respectively, of the PID control process. The term $D_{SU}$ is a differential of the projected error that is generated with the following equation: $D_{SU}=Error_{SU}-Error_{(S-1)U}$ where $Error_{(S-1)U}$ is the error identified for the previous form S−1 during a previous iteration of the process 100. The term $A_{SU}$ is an accumulation term, or integral term, that is generated with the following equation: $A_{SU}=A_{(S-1)U}+Error_{SU}$ where $A_{(S-1)U}$ is the accumulated error identified for the previous form S−1 in process 100. The accumulated error $A_{SU}$ incorporates the predicted error value $Error_{SU}$ that is identified for the next form in the media web 14. The value of $LEinScheduler_{SU}$ is a time value corresponding to when the upstream print engine should begin printing the next form S on the media web 14.

Process 100 continues as the upstream print engine prints the first side image and one or more registration of form (ROF) marks on the media web (block 124). In the printer 5, the controller 50 generates firing signals for the inkjets in the printhead units 21A-21D beginning at the time identified by $LEinScheduler_{SU}$ to print the next form S. The ROF marks can include one or more printed lines, squares, or other marks that can be identified by an optical detector, such as optical detector 19B, when the media web 14 passes through the downstream print engine for duplex printing. The ROF marks correspond to a leading edge of the form as actually printed by the upstream print engine instead of being a pre-printed marking or hole that is formed separately from the printing of the first side form ink image. Process 100 is performed iteratively during the duplex printing process to enable the upstream print engine to form first side printed images that are registered with the leading edge indicators of the forms on the media web.

FIG. 1B depicts process 150 for printing second side ink images on the media web 14 with process direction registration with the first side images formed during process 100. Process 150 is performed concurrently with process 100 to enable the upstream print engine and downstream print engine to perform duplex printing of forms on a single media web. Process 150 begins by moving the media web through the media path in the upstream print engine and downstream print engine at a substantially constant speed (block 154). The print medium moves through the upstream and downstream print engines at substantially the same constant speed in the processes 100 and 150.

Process 150 continues by identifying leading form edges of multiple forms on the media web 14 with reference to the registration of form (ROF) marks that were formed on the first printed side of each form during the first side printing of process 100 (block 158). In the printer 5, the optical detector 19B detects the printed ROF marks as the media web 14 approaches the downstream print engine for second side printing. The controller 50 identifies a time at which the upstream sensor 19B generates a signal corresponding to the indicator passing the upstream sensor 19B. The controller 50 identifies a series of time values corresponding to the leading edge indicators in a series of forms in the media web 14. In one embodiment, the controller 50 stores a running window of n previous leading edge indicators, where n corresponds to a number of forms that occupy a predetermined length of the media web 14 in the process direction. In one embodiment, the controller 50 stores time values corresponding to ROF marks for forms arranged along a length of 1.5 meters of the media web 14. In the example of FIG. 6, the downstream print engine 612 includes an optical detector that generates a signal when the printed ROF in the first side printed form passes the optical detector as the form approaches the downstream print engine, an a controller in the downstream print engine 612 stores time values corresponding to the series ROF marks for n forms.

During process 150, the downstream print engine identifies a form length variation parameter corresponding to timing variations of the identification of leading edge indicators for different forms in the media web 14 (block 162). In the downstream print engine, the form length variation parameter is another form deformation gain value $G_{DD}$, which includes identified time values corresponding to the leading edges of forms in both the upstream and downstream print engines. In the printer 5, the controller 50 identifies the downstream gain value $G_{DD}$ with the following equation:

$$G_{DD} = \frac{LE_D(k) - LE_D(k-n)}{e1LE_U(k) - e1LE_U(k-n)}$$

where $LE_D(k)$ and $LE_D(k-n)$ are two different dot clock count values at which the downstream print engine detects the ROF marks in two forms on the media web 14 that are separated by n forms in the process direction and $e1LE_U(k)$ and $e1LE_U(k-n)$ is the dot clock count values when upstream engine put the ROF marks on the media. As with the gain factor $G_{DU}$ in the upstream print engine, the value of $G_{DD}$ is one when the forms in the media web have the expected length in the process direction, greater than one when the forms stretch, and less than one when the forms shrink.

Process 150 continues by identifying a predicted timing error for a form that is scheduled to be printed by the downstream print engine with reference to an identified media web drift parameter and the identified web deformation gain value (block 166). In the printer 5, the controller 50 identifies the predicted error time offset $Error_{SD}$ using the following equation: $Error_{SD}=(LE_D(k)-LE_D(k-m))-G_{DD}\cdot(e1LE_U(k)-e1LE_U(k-m))$. The web drift is measured from a dot clock count value for the form identifier k measured for the detection of a leading edge indicator for a current form to a previous form at the earlier dot clock count value for the form identifier (k−m). The value of m represents a predetermined number of forms that the controller 50 monitors to identify drift in the media web 14. In one embodiment of process 150, the value of m is smaller than the value of n used to monitor web deformation during the processing of block 162 that is described above. The predicted error, $Error_{SD}$, is identified with reference to the downstream gain factor $G_{DD}$ and to the measured time difference for detection of the leading edge of the same two forms in the upstream print engine. As described above, the upstream print engine prints ROF marks, such as ROF marks 408A-408E in FIG. 4, during the first side printing process, and the downstream print engine identifies the leading edge of each form with reference to the ROF marks. The shorter time window for measuring web drift enables the controller 50 to identify drift in the media web over shorter time periods and to adjust the timing for operation of the printhead units 21A-21D to produce second side printed images that are aligned in the process direction P with first side printed images in each form.

Process 150 does not use the predicted error value $Error_{SD}$ to adjust the operation of the printhead units 21A-21D directly because random variations in the printing process can introduce inaccuracies into the error estimates that are produced for individual forms in the media web 14. Instead, the process 150 uses the predicted error value to update a PID control process for selecting a time at which to form the second side printed image that is registered with the first side image (block 170). The PID controller generates an identified time schedule offset for the next printed form S with reference to the following equation:

$$LEinScheduler_{SD} = LEinSchedulur_{(S-1)D} + \left(\frac{(LE_D(k) - LE_D(k-n))}{n}\right) + K_p \cdot Error_{SD} + K_I \cdot A_{SD} + K_D \cdot D_{SD}.$$

In the previous equation, $LEinSchedulur_{(S-1)D}$ represents a previously identified time scheduler value that is identified during the previous iteration of the process 150 and corresponds to the time of operation for the printhead units 21A-21D when printing the second side image on the previous form. The term $$\left(\frac{(LE_D(k) - LE_D(k-n))}{n}\right)$$

represents an expected time offset for printing the next form S in the absence of media web distortion or media web drift in the downstream print engine. The terms $K_P$, $K_I$, and $K_D$ are empirically determined constants corresponding to the proportional, integral, and differential terms, respectively, of the PID control process. In one embodiment, the constants $K_P$, $K_I$, and $K_D$ used in the process 150 have the same values as the constants in the PID controller for the upstream print engine that is described in process 100. In another embodiment, the PID controllers in both the upstream and downstream print engines use different values for the constants $K_P$, $K_I$, and $K_D$. The term $D_{SD}$ is a differential of the projected error that is generated with the following equation: $D_{SD}=Error_{SD}-Error_{(S-1)D}$ where $Error_{(S-1)D}$ is the error identified for the previous form S−1 during a previous iteration of the process 150. The term $A_{SD}$ is an accumulation term, or integral term, that is generated with the following equation: $A_{SD}=A_{(S-1)D}+Error_{SD}$ where $A_{(S-1)D}$ is the accumulated error identified for the previous form S−1 in process 150. The accumulated error $A_{SD}$ incorporates the predicted error value $Error_{SD}$ that is identified for the next form in the media web 14. The value of $LEinScheduler_{SD}$ is a time value corresponding to when the downstream print engine should begin printing the second side of the next form S on the media web 14.

Process 150 continues as the downstream print engine forms the second side printed image on the media web for the form S at the time identified in $LEinScheduler_S$ (block 174). In the printer 5, the controller 50 generates firing signals for the inkjets in the printheads in the print units 21A-21D that are aligned with the second side of the media web 14 beginning at the identified time to form the second side printed image. Process 150 is performed iteratively during the duplex printing process to enable the downstream print engine to form second side printed images that are registered with the first side printed images and the forms in the process direction.

Processes 100 and 150 are directed to printing in a duplex mode when the media web moves through the upstream and downstream print engines at a substantially constant speed in the process direction. During a printing process, however, the media web can accelerate and decelerate for a variety of reasons. For example, the media web accelerates to an operating speed after a fresh roll of paper is fed through the duplex media path in the printer 5, and the media web decelerates to a halt prior to printer cleaning and maintenance operations. Processes 200 and 250 describe alternatives to the processes 100 and 150, respectively, for enabling duplex printing with process direction registration when the media web is accelerating or decelerating. In the discussion below, a reference to the processes performing a function or action refers to a controller executing programmed instructions stored in a memory to operate one or more components in a printer to perform the function or action. Processes 200 and 250 are described in conjunction with the printer 5 for illustrative purposes.

Figure 2A:
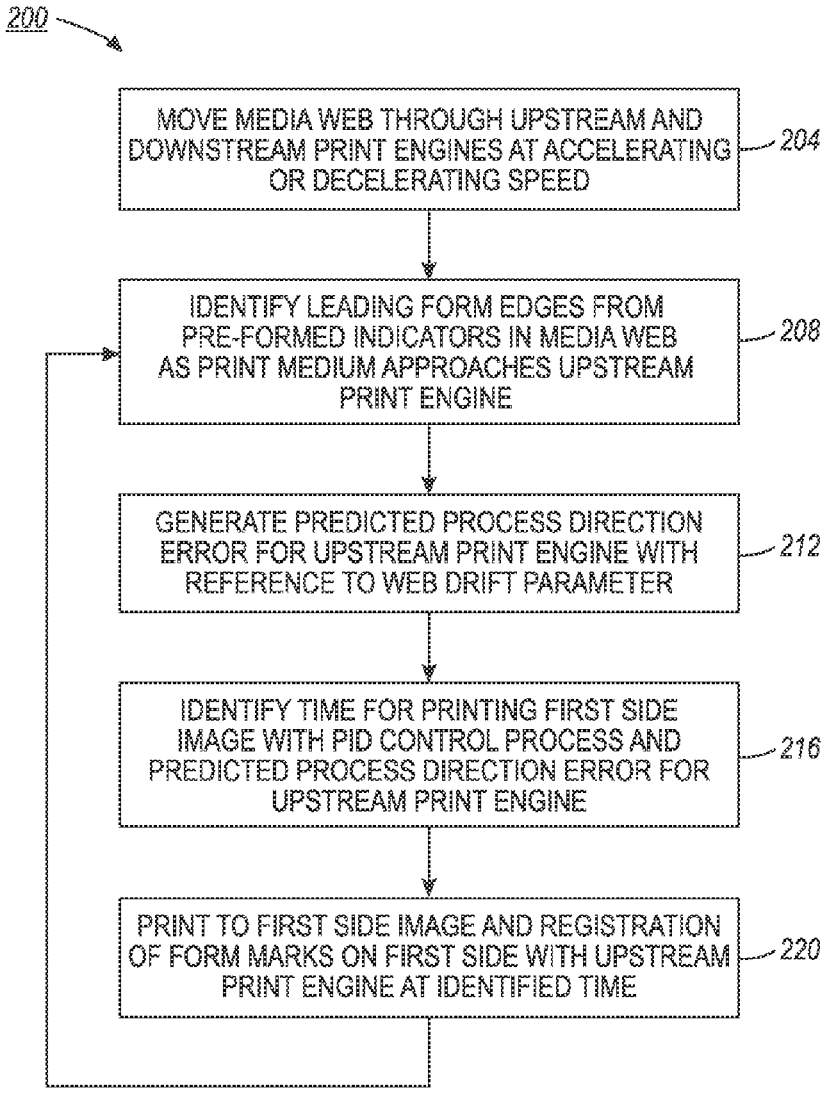
FIG. 2A is a block diagram of a process for printing first side images that are aligned with a plurality of forms on a first side of a media web that is accelerating or decelerating.

Referring to FIG. 2A, process 200 is directed to printing images in registration with forms on the media web in the upstream print engine. Process 200 begins by moving the media web through the upstream and downstream print engines at an accelerating or decelerating speed (block 204). In the printer 5, the media web 14 moves along the media path through the print zone 20 for first side printing, web inverter 84, and print zone 20 again for second side printing at a varying rate. Due to changes in tension on the media web, the magnitude of acceleration or deceleration for the media web 14 can vary along different portions of the media path.

As the media web 14 approaches the print zone 20, the printer 5 identifies pre-formed leading edge indicators for the individual forms in the media web 14 (block 208). The printer 5 identifies the leading edge indicators in the media web with processing (block 208) that is similar to the processing described above with reference to block 108 in process 100. Process 200 continues as the printer identifies a predicted process direction error in the upstream print engine for an upstream form S with reference to drift parameter in the media web (block 212). In the printer 5, the controller 50 identifies the error with reference to the following equation: $Error'_{SU}=(LE_U(k)-LE_U(k-m))-m\cdot LastEstimatedFormLengthU$, where the web drift is measured from a dot clock count value corresponding to the form identifier k that is measured for the detection of a leading edge indicator for the current form k to a previous form at the earlier dot clock count value for form identifier (k−m). The value of m represents a predetermined number of forms that the controller 50 monitors to identify drift in the media web 14. Each of the forms has a predetermined process direction length represented by the LastEstimatedFormLengthU variable in dot clock count as unit. The term LastEstimatedFormLengthU corresponds to either the expected length of each form on the media web 14 during a printer startup operation as the media web 14 accelerates to a constant operating speed, or to the identified length of each form on the media web 14 during process 100 prior to the printer 5 changing from a constant web speed operating mode to a decelerating web speed operating mode.

Process 200 identifies a predicted error for the form S in a similar manner to the error predicted in process 100, but process 200 identifies the error only with reference to drift of the media web 14 instead of identifying error with reference to both media drift and form length distortion. During acceleration and deceleration of the media web 14, the identification of form length distortion for individual forms in the media web 14 may be inaccurate due to the changing speed of the media web 14. The inaccuracies may lead to errors in registering the first side printed images on the media web 14, so process 200 only identifies the predicted error $Error'_{SU}$ with reference to identified media web drift.

Process 200 does not use the predicted error value generated during the processing described in block 212 to adjust the timing of operation of the printhead units 21A-21D directly because random variations in the printing process can introduce inaccuracies into the error estimates that are produced for individual forms in the media web 14. Instead, process 200 generates a timing correction value using a proportional, integral, differential (PID) control process that incorporates the predicted error value (block 216). The PID controller generates an identified time schedule offset for the next printed form S with reference to the following equation:

$$LEinScheduler'_{SU} = LEinSchedulur'_{(S-1)U} + \left(\frac{(LE_U(k) - LE_U(k-n))}{n}\right) + K'_p \cdot Error'_{SU} + K'_I \cdot A_{SU} + K'_D \cdot D_{SU}.$$

In the previous equation, $LEinSchedulur'_{(S-1)U}$ represents a previously identified time scheduler value that is identified during the previous iteration of the process 200 and corresponds to the time of operation for the printhead units 21A-21D when printing an image on a previous form while the media web accelerates or decelerates. The term $$\left(\frac{(LE_U(k) - LE_U(k-n))}{n}\right)$$

represents an expected time offset for printing the next form S in the absence of media web distortion or media web drift.

The terms $K'_P$, $K'_I$, and $K'_D$ are empirically determined constants corresponding to the proportional, integral, and differential terms, respectively, of the PID control process. The values of the terms $K'_P$, $K'_I$, and $K'_D$ can be different than the terms $K_P$, $K_I$, and $K_D$ for the PID controllers depicted in process 100 to enable improved registration of the printed images on the forms when the media web 14 is accelerating or decelerating. The terms $D_{SU}$ and $A_{SU}$ correspond to differential and accumulated error values that are calculated with processing similar to that described above with reference to block 120 in FIG. 1A, with the exception that the $D_{SU}$ and $A_{SU}$ equations use the predicted error value $Error'_{SU}$ that is generated in the processing of block 212 described above. The value of $LEinScheduler'_S$ is a time value corresponding to when the upstream print engine should begin printing the next form S on the media web 14.

Process 200 continues as the upstream print engine prints the first side image and one or more ROF marks on the media web (block 220). In the printer 5, the controller 50 generates firing signals for the inkjets in the printhead units 21A-21D beginning at the time identified by $LEinScheduler'_{SU}$ to print the next form S. Process 200 is performed iteratively during the duplex printing process to enable the upstream print engine to form first side printed images that are registered with the leading edge indicators of the forms on the media web.

Figure 2B:
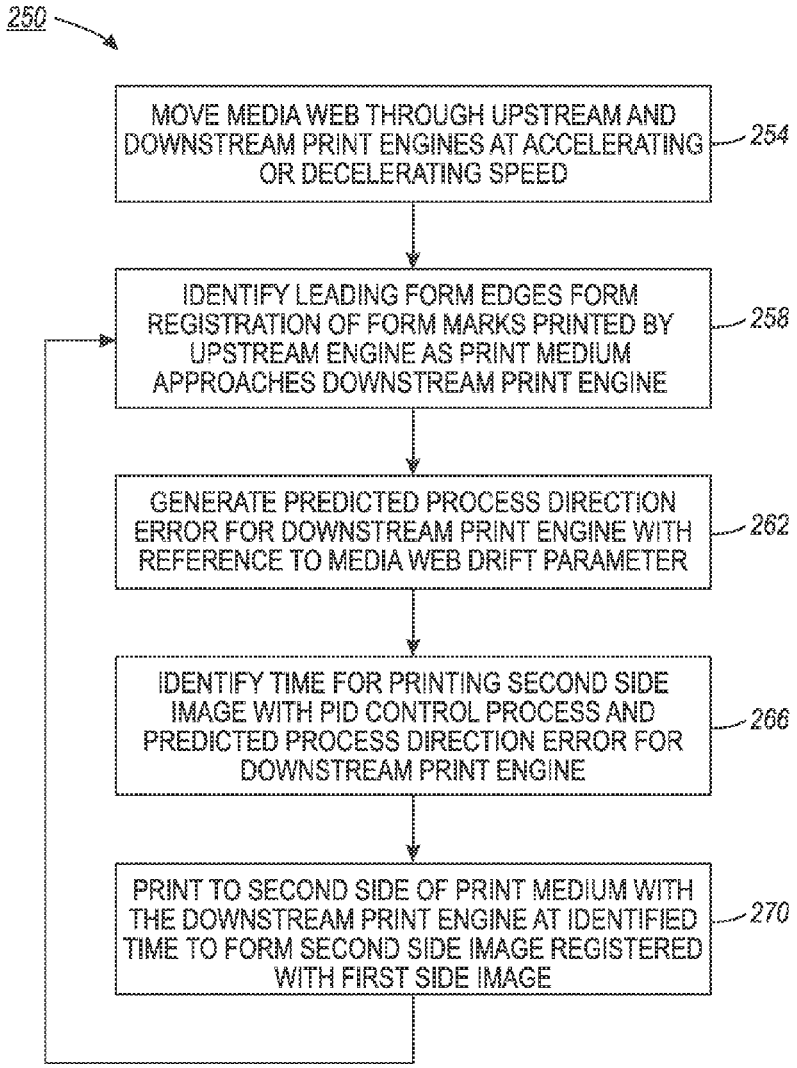
FIG. 2B is a block diagram of a process for printing second side images on a second side of the media web that are registered to the first side images while the media web is accelerating or decelerating.

FIG. 2B depicts process 250 for printing second side ink images on the media web 14 with process direction registration with the first side images formed during process 200 while the media web accelerates or decelerates. Process 250 is performed concurrently with process 200 to enable the upstream print engine and downstream print engine to perform duplex printing of forms on a single media web. Process 250 begins by moving the media web through the upstream and downstream print engines at an accelerating or decelerating speed (block 254) in the same manner as described above in process 200.

Process 250 continues by identifying leading form edges of multiple forms on the media web 14 with reference to the registration of form (ROF) marks that were formed on the first printed side of each form during the first side printing of process 200 (block 258). Process 250 identifies the ROF marks as the forms approach the print zone in the downstream print engine with processing substantially similar to the processing described above with reference to block 158 in process 150. Process 250 next identifies a predicted process direction error in the upstream print engine for an upstream form S with reference to drift parameter in the media web (block 262). In the printer 5, the controller 50 identifies the error with reference to the following equation: $Error'_{SD}=(LE_D(k)-LE_D(k-m))-m\cdot LastEstimatedFormLengthD$ where the web drift is measured from a dot clock count value for the form identifier k measured for the detection of an ROF for a current form to a previous form at the earlier dot clock count value for the form identifier (k−m). Process 250 identifies a predicted error for the form S in a similar manner to the error predicted in process 150, but process 250 identifies the error only with reference to drift of the media web 14 instead of identifying error with reference to both media drift and form length distortion. Each of the forms has a predetermined process direction length represented by the LastEstimatedFormLengthD variable in dot clock as unit. The term LastEstimatedFormLengthD corresponds to either the expected length of each form on the media web 14 during a printer startup operation as the media web 14 accelerates to a constant operating speed, or to the identified length of each form on the media web 14 during process 150 prior to the printer 5 changing from a constant web speed operating mode to a decelerating web speed operating mode.

Process 250 identifies a time at which to print the upstream form S using a PID control process (block 266). In the printer 5, the controller 50 identifies the scheduled time with the following equation:

$$LEinScheduler'_{SD} = LEinSchedulur'_{(S-1)D} + \left(\frac{(LE_D(k) - LE_D(k-n))}{n}\right) + K'_p \cdot Error'_{SD} + K'_I \cdot A_{SD} + K'_D \cdot D_{SD}.$$

In one embodiment, the PID constants $K'_P$, $K'_I$, and $K'_D$ that are used with the downstream print engine PID controller in process 250 have the same values as the constants used with the upstream print engine PID controller in the process 200. The terms $D_{SD}$ and $A_{SD}$ correspond to differential and accumulated error values that are calculated with processing similar to the processing described above with reference to block 170 in FIG. 1B, with the exception that the $D_{SD}$ and $A_{SD}$ equations use the predicted error value $Error'_{SD}$ that is generated in the processing described above with reference to block 262.

Process 250 continues as the downstream print engine forms the second side printed image on the media web for the form S at the time identified in $LEinScheduler'_{SD}$ (block 270). In the printer 5, the controller 50 generates firing signals for the inkjets in the printheads in the print units 21A-21D that are aligned with the second side of the media web 14 beginning at the identified time to form the second side printed image. Process 250 is performed iteratively during the duplex printing process when the media web is accelerating or decelerating to enable the downstream print engine to form second side printed images that are registered with the first side printed images and the forms in the process direction.

It will be appreciated that variants of the above-disclosed and other features, and functions, or alternatives thereof, may be desirably combined into many other different systems or applications. Various presently unforeseen or unanticipated alternatives, modifications, variations, or improvements therein may be subsequently made by those skilled in the art, which are also intended to be encompassed by the following claims.

What is claimed is:

1. A method for operating a duplex printer comprising:

identifying a leading edge of a first side of each form in a plurality of forms on a media web moving past a first printhead configured to eject ink onto the first side of each form, the leading edge of each form being identified with reference to a form length variation parameter associated with the first printhead and a drift parameter associated with the first printhead; and identifying a leading edge of a second side of each form in the plurality of forms moving past a second printhead configured to eject ink onto the second side of each form that is a reverse side of the first side of each form, the leading edge of each form on the reverse side being identified with reference to a form length variation parameter associated with the second printhead and a drift parameter associated with the second printhead, the form length variation parameter and the drift parameter associated with the second printhead being generated with reference to a plurality of leading edge identifications generated for the plurality of forms moving past the first printhead.

2. The method of claim 1, the identification of the leading edge of each form moving past the first printhead further comprising:

identifying the form length variation parameter and the drift parameter associated with the first printhead with reference to detection of a plurality of marks on the media web and a predetermined form length.

3. The method of claim 2, the identification of the form length variation parameter and the drift parameter associated with the first printhead further comprising:

identifying the form length variation parameter associated with the first printhead with a first number of mark detections; and identifying the drift parameter associated with the first printhead with a second number of mark detections, the second number being less than the first number.

4. The method of claim 1, the identification of the leading edge of each form moving past the second printhead further comprising:

identifying the form length variation parameter and the drift parameter associated with the second printhead with reference to detection of a plurality of marks on the first side of the plurality of forms on the media web and a predetermined form length.

5. The method of claim 4, the identification of the form length variation parameter and the drift parameter associated with the second printhead further comprising:

identifying the form length variation parameter associated with the second printhead with a first number of mark detections on the first side of the plurality of forms on the media web; and identifying the drift parameter associated with the second printhead with a second number of mark detections on the first side of the plurality of forms on the media web, the second number being less than the first number.

6. The method of claim 1 further comprising:

updating a first proportional-integral-derivative (PID) controller with reference to the form length variation parameter associated with the first printhead and the drift parameter associated with the first printhead;

identifying a first time at which to operate the first printhead to print an image on the first side of the form with reference to the updated first PID controller; and operating the first printhead at the identified first time to print an ink image on the first side of the form.

7. The method of claim 6 further comprising:

updating a second proportional-integral-derivative (PID) controller with reference to the form length variation parameter associated with the second printhead and the drift parameter associated with the second printhead;

identifying a second time at which to operate the second printhead to print an image on the second side of the form with reference to the updated second PID controller; and operating the second printhead at the identified second time to print an ink image on the second side of the form.

8. The method of claim 7 further comprising:

updating the second PID controller with reference only to the drift parameter associated with the second printhead in response to one of an acceleration and a deceleration of a speed of the media web in a process direction moving past the second printhead.

9. The method of claim 6 further comprising:

updating the first PID controller with reference only to the drift parameter associated with the first printhead in response to one of an acceleration and a deceleration of a speed of the media web in a process direction moving past the first printhead.

10. A duplex printing system comprising:

a media transport configured to move a media web in a process direction past a first printhead that is configured to print on a first side of the media web and a second printhead that is configured to print on a second side of the media web, the second printhead being located from the first printhead in the process direction to enable the second printhead to print the second side of the media web after the first printhead has printed the first side of the media web;

a first optical detector configured to generate a first signal in response to detection of a form indicator corresponding to one form in a plurality of forms on the first side of the media web passing the first optical detector;

a second optical detector configured to generate a second signal in response to detection of a mark printed by the first printhead in the form on the first side of the media web passing the second optical detector; and a controller operatively connected to the first printhead, second printhead, first optical detector, second optical detector, and a memory, the controller being configured to:

identify a leading edge of a first side of each form in the plurality of forms on the media web, the leading edge of each form being identified with reference to a form length variation parameter associated with the first printhead and a drift parameter associated with the first printhead; and identify a leading edge of a second side of each form in the plurality of forms moving past a second printhead configured to eject ink onto the second side of each form that is a reverse side of the first side of each form, the leading edge of each form on the reverse side being identified with reference to a form length variation parameter associated with the second printhead and a drift parameter associated with the second printhead, the form length variation parameter and the drift parameter associated with the second printhead being generated with reference to a plurality of leading edge identifications generated for the plurality of forms moving past the first printhead.

11. The printer of claim 10, the controller being further configured to:

identify the form length variation parameter and the drift parameter associated with the first printhead with reference to detection of a plurality of marks by the first optical detector on the media web and a predetermined form length.

12. The printer of claim 10, the controller being further configured to:

identify the form length variation parameter and the drift parameter associated with the second printhead with reference to detection of a plurality of marks by the second optical detector on the first side of the plurality of forms on the media web and a predetermined form length.

13. The printer of claim 12, the controller being further configured to:

identify the form length variation parameter associated with the first printhead with a first number of mark detections by the first optical detector; and identify the drift parameter associated with the first printhead with a second number of mark detections by the first optical detector, the second number being less than the first number.

14. The printer of claim 13, the controller being further configured to:

identify the form length variation parameter associated with the second printhead with a first number of mark detections by the second optical detector on the first side of the plurality of forms on the media web; and identify the drift parameter associated with the second printhead with a second number of mark detections by the second optical detector on the first side of the plurality of forms on the media web, the second number being less than the first number.

15. The printer of claim 10, the controller being further configured to:

perform stored program instructions to update a first proportional-integral-derivative (PID) control process with reference to the form length variation parameter associated with the first printhead and the drift parameter associated with the first printhead;

identify a first time at which to operate the first printhead to print an image on the first side of the form with reference to the updated first PID control process; and operate the first printhead at the identified first time to print an ink image on the first side of the form.

16. The printer of claim 15, the controller being further configured to:

perform stored program instructions to update a second proportional-integral-derivative (PID) control process with reference to the form length variation parameter associated with the second printhead and the drift parameter associated with the second printhead;

identify a second time at which to operate the second printhead to print an image on the second side of the form with reference to the updated second PID control process; and operate the second printhead at the identified second time to print an ink image on the second side of the form.

17. The printer of claim 16, the controller being further configured to:

perform the stored program instructions to update the second PID control process with reference only to the drift parameter associated with the second printhead in response to one of an acceleration and a deceleration of a speed of the media web in the process direction moving past the second printhead.

18. The printer of claim 15, the controller being further configured to:

perform the stored program instructions to update the first PID control process with reference only to the drift parameter associated with the first printhead in response to one of an acceleration and a deceleration of a speed of the media web in the process direction moving past the first printhead.

* * * * *